US007014523B2

(12) United States Patent
Anderson

(10) Patent No.: US 7,014,523 B2
(45) Date of Patent: Mar. 21, 2006

(54) VECTOR TOY

(76) Inventor: John H. Anderson, 214 Goldenrod Ave., Corona del Mar, CA (US) 92625

( * ) Notice: Subject to any disclaimer, the term of this patent is extended or adjusted under 35 U.S.C. 154(b) by 0 days.

(21) Appl. No.: 10/928,076

(22) Filed: Aug. 27, 2004

(65) Prior Publication Data

US 2005/0048864 A1 Mar. 3, 2005

Related U.S. Application Data

(60) Provisional application No. 60/498,615, filed on Aug. 27, 2003.

(51) Int. Cl.
*A63H 27/00* (2006.01)

(52) U.S. Cl. ..... 446/48; 446/236

(58) Field of Classification Search ..... 446/46–48, 446/61, 66, 67, 236, 233, 247–250
See application file for complete search history.

(56) References Cited

U.S. PATENT DOCUMENTS 2,864,201 A * 12/1958 Leise ..... 446/46
3,312,472 A * 4/1967 Kerr ..... 473/589
3,566,532 A * 3/1971 Wilson ..... 446/46
3,765,122 A * 10/1973 English ..... 446/48
4,112,612 A * 9/1978 Woods ..... 446/48
4,196,540 A * 4/1980 Hembree et al. ..... 446/46
4,241,533 A * 12/1980 Newsome ..... 446/46
4,356,660 A * 11/1982 O'Brien ..... 446/256
4,560,358 A * 12/1985 Adler ..... 446/46
4,854,907 A * 8/1989 Holmes ..... 446/48
4,944,707 A * 7/1990 Silverglate ..... 446/48
5,199,708 A * 4/1993 Lucas ..... 273/126 R
5,476,405 A * 12/1995 Clayborne ..... 446/236
5,984,753 A * 11/1999 Perez ..... 446/46
6,113,453 A * 9/2000 Stuffelbeam ..... 446/46
6,585,552 B1 * 7/2003 Huset ..... 446/46
6,599,162 B1 * 7/2003 Huset ..... 446/46

* cited by examiner

*Primary Examiner*—Kien Nguyen
(74) *Attorney, Agent, or Firm*—Cislo & Thomas LLP

(57) ABSTRACT

Embodiments disclosed herein may include a toy method and system configured to be displaced for generally long distances by a small force. The disc-like or ring-like device may utilize wind-related vortex forces to remain generally upright and moving for long distances. Furthermore, the system may comprise an aperture, and may have a aerodynamic configuration to achieve the movement and/or provide for use as a flying disc. The ring-like device may be configured as an annular wing having a symmetrical airfoil configuration and as such may be used both as a wind-driven rolling toy and as a hand-tossed flying ring.

31 Claims, 3 Drawing Sheets

VECTOR TOY

CROSS-REFERENCE TO RELATED APPLICATIONS

This application claims the benefit of U.S. Provisional Patent Application No. 60/498,615, entitled VORTEX TOY, filed on Aug. 27, 2003, which is hereby incorporated by reference in its entirety for all purposes, and attached hereto as an Appendix.

BACKGROUND

Wind driven toys are quite popular. For instance, familiar wind driven toys may include kites, toy sailboats, and pinwheels, among others. Toys for use in the outdoors are very popular and may be increasing in popularity with the recent increase of people enjoying outdoor activities. Quite often, even the slightest breeze may bring out a number of kite fliers, flying everything from the simplest kite to very elaborate stunt kites. Additionally, pinwheels, and other such wind driven toys can be amusing to watch on breezy days.

Wind-actuated toys may suffer from a serious drawback. Some wind driven toys may be static, in that the user of a kite or toy sailboat, for example, uses these devices while remaining substantially stationary. Such devices are incompatible with the desire to enjoy a breezy day while exercising. This drawback of these toys may be especially noticeable given the emphasis on activity and exercise prevalent in society today. It is quite well known that a sedentary lifestyle and maintaining a healthy body are mutually exclusive ideas. Therefore, it may be advantageous to have a toy, which would allow people to have fun on a windy day as kites, and other such devices allow, while also providing the opportunity for enjoying an aerobic workout. Such a toy may also encourage people to abandon indoor, sedentary habits and activities, such as video games, watching television, and the like.

A drawback of many other popular toys may be that they require a power source of some sort, whether batteries or otherwise. Advantageously, with the increased emphasis on environmental friendliness in all aspects of peoples' lives, a decrease in power consumption and/or disposable battery consumption may be beneficial and may be enjoyed by all. Therefore, it may be desirable to have a toy which does not require an outside, polluting power source. Furthermore, it may be advantageous to have a uniquely simple, nature-animated, non-polluting action toy.

It may also be advantageous to have a toy that would travel relative long distances with little or no force imparted to it by a user. Yet further, it would be advantageous to have an inexpensive toy that can be easily replaced if broken. It may also be advantageous to have a toy that may be relatively easily constructed, assembled and used, so that a person of any age may use it.

SUMMARY

Embodiments disclosed herein may include a toy method and system configured to be displaced for generally long distances by a small force. The disc-like or ring-like device may utilize wind-related vortex forces to remain generally upright and moving for long distances. Furthermore, the system may comprise an aperture, and may have a aerodynamic configuration to achieve the movement and/or provide for use as a flying disc. The ring-like device may be configured as an annular wing having a symmetrical airfoil configuration and as such may be used both as a wind-driven rolling toy and as a hand-tossed flying ring.

DETAILED DESCRIPTION

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of this disclosure.

Figure 1:
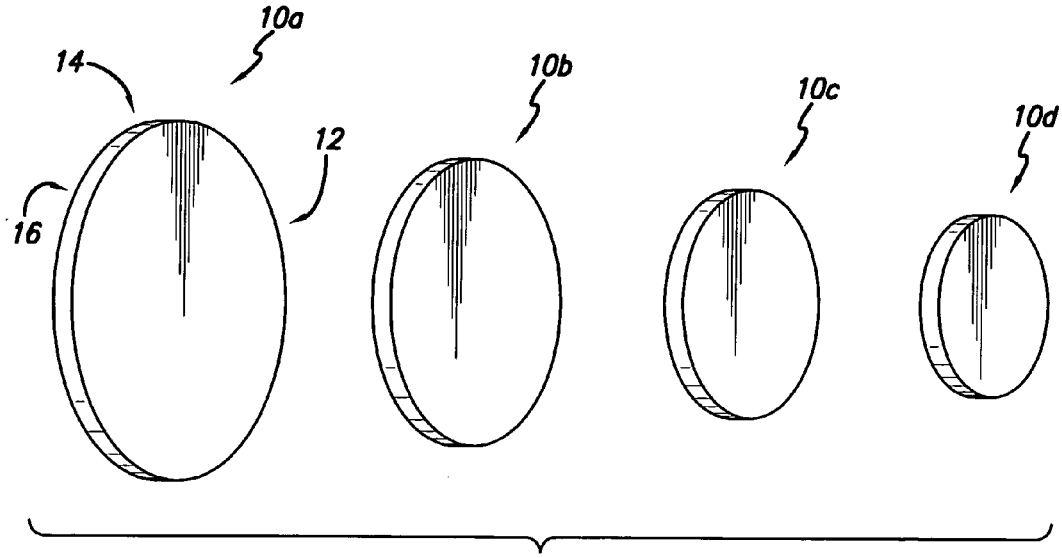
FIG. 1 is a perspective view of different sizes of an exemplary embodiment of a disc-like system.

Exemplary embodiments of a system are shown in FIG. 1, generally corresponding to systems 10*a–d*. Referring to system 10*a* may include a body portion, which may include a particular thickness 14 as well as an edge portion 16. Body portion 12 is shown generally as a disc with a thickness 14, however other configurations may be utilized. Furthermore, body portion 12 may include an edge 16 which the system may travel upon on a support surface. The systems 10*a–d* may be designed to utilize vortex forces of the wind, breeze, and/or other forces to travel very long distances with very little force acting upon it. With this configuration, children and others may enjoy the use of this toy as it may travel very long distances with very little effort. Furthermore with a slight breeze, the child may direct it along edge 16 such that the force of the wind propels the system forward and the vortex effect of the wind automatically stabilizes the system, thus allowing the toy to travel relatively long distances.

As shown by systems 10*b*, 10*c*, and 10*d*, the system may be in various sizes that may be limited by the vortex forces that may be created when a wind or slight breeze acts upon the particular configuration. With this configuration some systems that are too large or too small may not operate as desired. It will be appreciated that although a generally disc shape is shown for systems 10*a–d*, other configurations may be utilized without straying from the concepts disclosed herein. Furthermore, although a generally flat edge 16 is shown in FIG. 1, other edge configurations may be utilized for different desired effects and characteristics of a system.

System 10 may be made out of expanded polystyrene, polyethylene, light cardboard, balsawood, or other lightweight sturdy material, however other materials may be used, as desired. Furthermore, system 10 may be utilized as an advertising device where a company may put its logo or design on it. This may be an ideal configuration as system 10 may be very inexpensive to manufacture, thus allowing an advertiser to give away many at a low cost. Furthermore, many of these systems may be purchased by, or for, children. Therefore, these systems may become similar to trading cards, and the like.

The Von Karman vortex may be a double trail of vortices formed alternately, on both sides of a device moving at right angles to its axis through a fluid or air. The vortices in one row may rotate in a direction opposite to that of the other row. This interesting action affects many structures and configurations in the flow of air or liquids. When the wind blows, a pair of vortices on either side of a system as disclosed herein, may lift and propel the system. These vortices may cause a wacky, wobbly, propulsion in a light breeze, and a faster propulsion with less wobble, at higher wind speeds.

When a light breeze acts upon a system as disclosed herein, the system may be started moving with a very slight push and may continue to move in a wobbling and amusing manner, sometimes at improbable angles to the ground, as it proceeds. With a light breeze, the system may proceed at a leisurely pace. As the wind speed increases, the system may wobble correspondingly less, and move correspondingly faster, easily reaching a rapid running speed of a child or other user. Furthermore, the system may demonstrate an otherwise unseen environmental forces of wind as is provides for stabilization and propulsion of the rolling system.

When used as a toy or promotional novelty, the vortex forces may affect the system and may allow a wobbling, rolling, and bouncing of the lightweight, low mass system. Furthermore, the size of the disc may be typically 3–12 inches in diameter, however other configurations and dimensions may be utilized, as desired. Each side of the system may be utilized to display various characters or graphic effects, such as advertisements, especially graphics that would be enhanced by a rolling movement, or designs that facilitate use on a generally round object.

In another exemplary embodiment, system 10 may be irregularly shaped, such as, but not limited to, egg-shaped, or any other shape that may allow the disc to travel as described herein. Furthermore, other configurations may cause the device to travel in an irregular manner, and may provide animation effects, among others.

Figure 2:
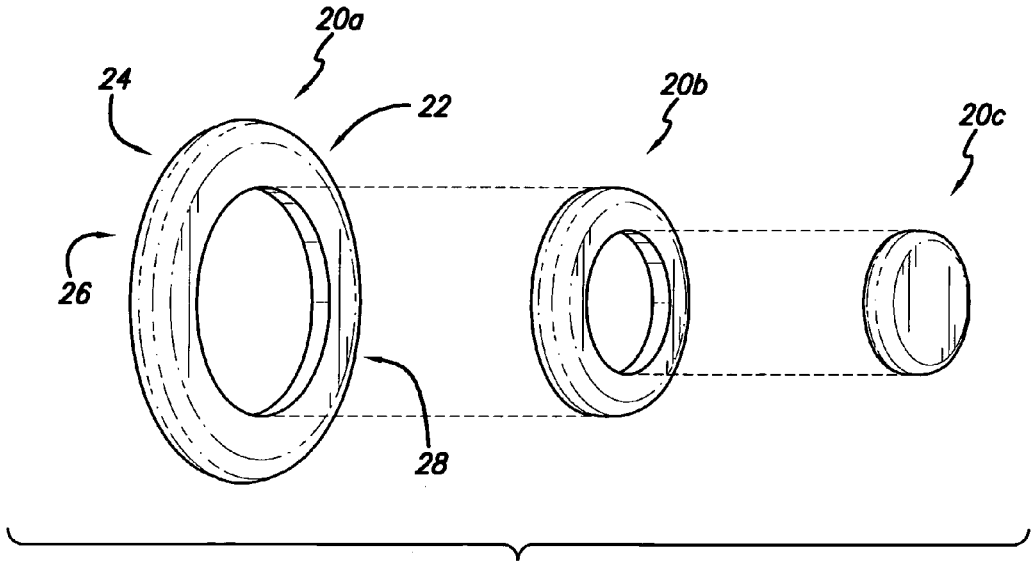
FIG. 2 is a perspective view of different sizes of an exemplary embodiment of a ring-like system.

FIG. 2 shows other embodiments of a toy system according to exemplary embodiments, generally at 20*a–c*. System 20*a* may include a body portion 22 which may be generally annular, and/or ring-like. Body portion 22 may again include a certain thickness 24 as well as an edge 26. In this embodiment body portion 22 includes an orifice 28, which makes it generally ring-like in shape. Again the system may be of other sizes as shown by systems 20*b* and 20*c* and again certain sizes may be advantageous to enhance the characteristics of the overall system.

As shown in this exemplary embodiment, systems 20*a–c* may be configured singularly or as concentric annular rings with or without a central disc. The rings may be configured with a symmetrical airfoil shape, which along with the system's generally low mass, may allow the ring to be alternatively utilized as a flying disc, as desired. Furthermore, this system may fly for a distance, then roll on the ground thereafter, propelled by the wind and stabilized by vortex effects. This may make the system more versatile and desirable for a potential purchaser, such as children and parents.

Figure 3:
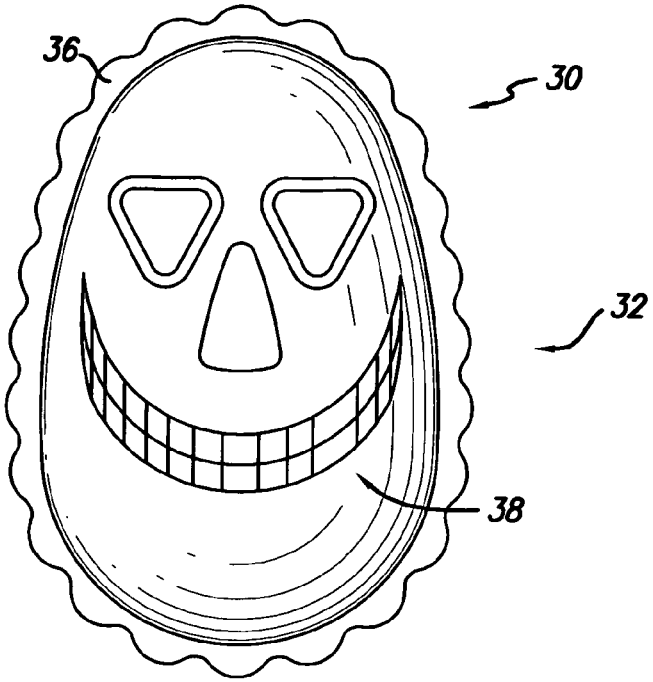
FIG. 3 is a perspective view of a 3-dimensional exemplary embodiment of a system.

FIG. 3 shows a system according to an exemplary embodiment, generally at 30. System 30 may include a body portion 32 which may have an edge 36. Furthermore body portion 32 may include ornamentalities 38, such as a jack-o-lantern face or other graphics and/or configurations, as desired. It will be appreciated that although a 3-dimensional mask or face is shown for body portion 32, many other 3-dimensional configurations may be utilized without straying from the concepts disclosed herein.

System 30 may have a non-circular shape such as an egg shape as shown, however it will be appreciated that many other non-annular configurations may be utilized to modify the characteristics of the system to produce different effects, as desired. Edge 36 may have an irregular surface configured to contact a support surface, as shown. It will be appreciated that many other irregular configurations for edge 36 may be utilized to alter the characteristics of the system, including but not limited to, bumps, gaps, a zigzag configuration, wave configuration, etc. Furthermore, these different configurations may cause the system to travel in many different manners, and may be utilized to create different effects.

Furthermore, the characteristics of each of a 3-dimensional system may enhance the characteristics of the overall system, which may make the system wobble and/or act irregularly when a force is acting upon it. This may enhance the play value of the system and may make the system very highly configurable for different uses as well as advertising and/or other configurations.

Figure 4:
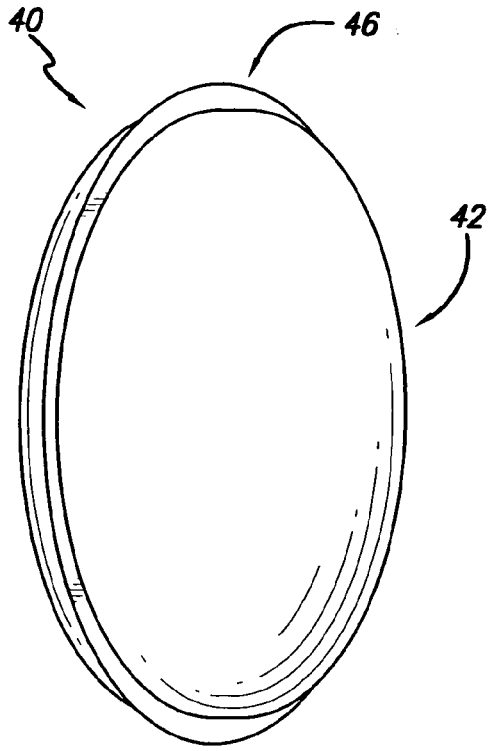
FIG. 4 is a perspective view of a selectively expandable system according to an exemplary embodiment.

FIG. 4 shows an exemplary embodiment of a system, generally at 40. System 40 may include a body portion 42 as well as an edge portion 46. In this embodiment, body portion 42 may be expandable by inflation and be made of mylar-type materials. Furthermore, system 40 may include an edge 46 to travel upon the support surface.

In this embodiment, edge 46 is generally very thin and non-cylindrical and may not have a very thick, flat surface. With this configuration, many different graphics may be utilized upon body portion 42 and edge portion 46. Edge portion 46 may be made of a plastic or other materials and/or combinations thereof such that the system may travel very long distances on a support surface with very little force acting upon it.

System 40 may also be configured as a generally ring-like edge portion 46 and a thin film body portion 42. System 40 may or may not be configured to be expandable and/or inflatable.

Figure 5A:
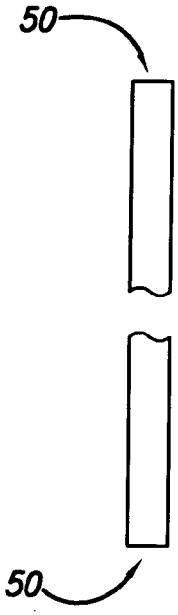
FIGS. 5*a–d* are elevational views of various edge configurations according to exemplary embodiments.

FIG. 5*a* shows an edge 50 of a system according to an exemplary embodiment. As shown in FIG. 5*a*, edge 50 may be a generally flat surface that may be configured to contact a support surface to allow the system to travel.

Figure 5B:
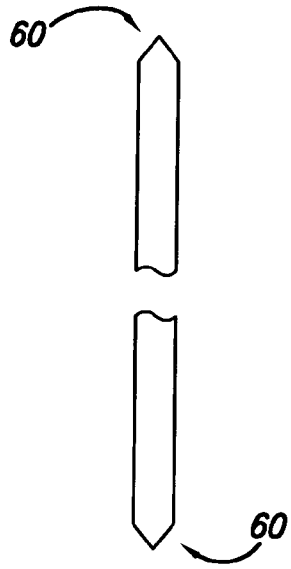

FIG. 5*b* shows another exemplary embodiment of an edge, generally at 60. In this embodiment, edge 60 has a generally very narrow cross-section, and may be generally V-shaped configuration. This configuration may allow the system to travel faster and may allow less force to be exerted upon the system to allow it to move very long distances. Furthermore this configuration may change the characteristics of the overall system such that it may act differently than other configurations, when in use.

Figure 5C:
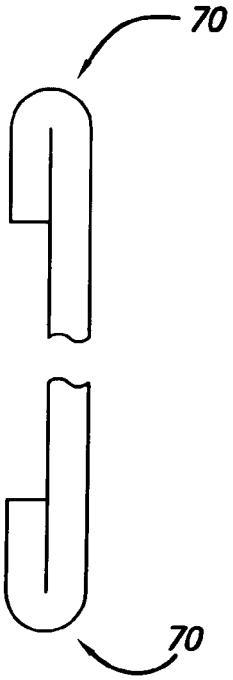

FIG. 5*c* shows another embodiment of an edge 70, of another exemplary embodiment. Edge 70 may be an overlapped configuration such that a rounded surface may contact the support surface. This configuration may alter the characteristics of the overall system and may produce different effects of the system when rolling, traveling, and moving and/or in use.

Figure 5D:
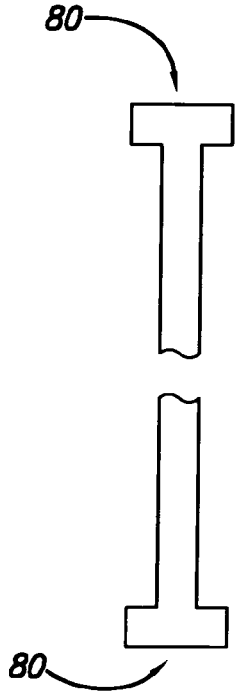

FIG. 5*d* shows another exemplary embodiment of an edge 80, according to an exemplary embodiment. In this embodiment edge 80 has a generally T-shaped configuration, which allows for a larger contact surface for which the system is contacting the support surface. Again this configuration may produce different effects and/or characteristics of the overall system than other edge configurations. Edges may be made of a plastic, metal, wood, polymers, or other materials, and/or combinations thereof, as desired.

Although systems disclosed herein may have been described as being made from an expanded polystyrene or polyethylene-type material, it may also be manufactured as an inflatable device made of mylar-type material, plastic, or other materials, or combinations thereof, as desired.

System disclosed herein may be configured with a surface area to weight ratio that may allow the system to operate better. That is, certain surface area to weight ratio may not operate properly or at all. Therefore the configuration of the system may be varied to alter the characteristics of the system to a certain extent.

However, at certain high and low surface area to weight ratios the system may not operate at all.

Furthermore, the systems' small size may allow it to be packaged, shipped, stored, and displayed in a smaller package such that it may be more appealing to retailers, among others. The systems may be in many different sizes, as needed for the particular application, as desired. Furthermore, the system may be manufactured and packaged as a printed die cut or molded disc and/or ring, in which one or more could be packaged together in a blister pack, or the like. It will be appreciated that many other packaging configurations may be used, such as, but not limited to, loose, with hang tags or other such packaging, as desired.

Systems disclosed herein may be wind-driven, simple, non-mechanized, action toys, which require no batteries, and little, if any assembly. These systems may also provide amusing actions where a user may walk or run along with a system enjoying exercise. Furthermore, other observers may enjoy the wobbly actions and appearance of the graphics of the system as it moves. Moreover, the play value may be enhanced when the system includes graphics that display a tumbling object such as a clown, acrobat, stunt car, surfer, or the like.

Furthermore, the systems or graphics may be glow in the dark or have other effects, as desired. It will be appreciated that lights, noisemakers, and the like may be incorporated into the systems, as desired.

In closing, it is to be understood that the exemplary embodiments described herein are illustrative of the principles of this disclosure. Other modifications that may be employed are within the scope of this disclosure. Thus, by way of example, but not of limitation, alternative configurations may be utilized in accordance with the teachings herein. Accordingly, the drawing and description are illustrative and not meant to be a limitation thereof.

What is claimed is:

1. A wind propelled toy system, comprising:

an edge configured for rolling along a support surface; and a means for utilizing vortex force for stabilization and propulsion of said system while said edge is rolling along said support surface;

wherein said system comprises a lightweight material having a density of approximately 3.75 pounds per cubic foot or less and a diameter within the range of approximately 3 inches to approximately 12 inches; and wherein vortex forces created by a wind stabilizes and propels said rolling movement of said system continuously for so long as said system encounters said wind.

2. The system of claim 1, wherein said means for utilizing vortex force stabilization and propulsion comprises a body portion.

3. The system of claim 2, wherein body portion is generally disc-shaped.

4. The system of claim 2, wherein body portion is non-annular.

5. The system of claim 2, wherein said body portion comprises a 3-dimensional configuration.

6. The system of claim 2, wherein body portion is selectively expandable.

7. The system of claim 2, wherein body portion is inflatable.

8. The system of claim 1, wherein said edge comprises an irregular surface configured to contact a support surface.

9. A wind propelled toy system, comprising:

an edge configured for rolling along a support surface; and a body portion configured to utilize vortex force for propulsion of said system while said edge is rolling along said support surface;

wherein said system comprises a lightweight material having a density of approximately 3.75 pounds per cubic foot or less and a diameter within the range of approximately 3 inches to approximately 12 inches; and wherein vortex forces created by a wind stabilizes and propels said rolling movement of said system continuously for so long as said system encounters said wind.

10. The system of claim 9, wherein said body portion further comprises a means for facilitating vortex force stabilization of said system.

11. The system of claim 10, wherein body portion is generally disc-shaped.

12. The system of claim 10, wherein body portion is non-annular.

13. The system of claim 10, wherein said edge comprises an irregular surface configured to contact a support surface.

14. The system of claim 10, wherein said body portion comprises a 3-dimensional configuration.

15. The system of claim 10, wherein body portion is selectively expandable.

16. The system of claim 10, wherein body portion is generally low mass and is configured as a symmetrical airfoil shape.

17. A method of playing with a toy, comprising:

providing a toy capable of utilizing vortex force for stabilization and propulsion, said toy comprising an edge configured for rolling along a support surface and a body portion, wherein said body portion comprises a lightweight material having a density of approximately 3.75 pounds per cubic foot or less and a diameter within the range of approximately 3 inches to approximately 12 inches;

initiating a rolling action of said toy along said support surface with a relatively small initial rolling force;

allowing existing prevailing winds to continuously stabilize and propel said toy for so long as said toy encounters said winds.

18. A method for enhancing the play value of a toy, comprising:

providing a toy capable of utilizing vortex effects for stabilization, said toy comprising an edge configured for rolling along a support surface and a body portion, wherein said body portion comprises a lightweight material having a density of approximately 3.75 pounds per cubic foot or less and a diameter within the range of approximately 3 inches to approximately 12 inches;

positioning said toy such that said toy may be initially propelled by an initial force provided by a user, and further propelled by an additional force created by existing prevailing winds;

initially propelling said toy such that it may travel in a continuously rolling motion so long as said toy encounters said prevailing winds.

19. The method of claim 18, wherein said additional force comprises wind.

20. The method of claim 18, wherein said additional force comprises vortex effect.

21. The method of claim 20, wherein said vortex effect keeps said toy generally upright.

22. A toy system, comprising:

an edge means configured for rolling along a support surface; and a means for facilitating vortex effect stabilization of said system while said edge means is rolling along said support surface;

wherein said system comprises a lightweight material having a density of approximately 3.75 pounds per cubic foot or less and a diameter within the range of approximately 3 inches to approximately 12 inches; and wherein vortex forces created by a wind stabilizes and propels said rolling movement of said system continuously for so long as said system encounters said wind.

23. The system of claim 22, wherein said system is propelled by a relatively small force provided by wind.

24. The system of claim 22, wherein said means for facilitating vortex effect stabilization comprises a body portion.

25. The system of claim 24, wherein body portion is generally disc-shaped.

26. The system of claim 24, wherein body portion is non-annular.

27. The system of claim 24, wherein said body portion comprises a 3-dimentional configuration.

28. The system of claim 24, wherein body portion is selectively expandable.

29. A propelled toy system, comprising:

an edge configured for rolling along a support surface; and a body portion configured to utilize vortex effect stabilization and wind force propulsion of said system while said edge is rolling along said support surface;

wherein said system comprises a lightweight material having a density of approximately 3.75 pounds per cubic foot or less and a diameter within the range of approximately 3 inches to approximately 12 inches; and wherein vortex forces created by a wind stabilizes and propels said rolling movement of said system continuously for so long as said system encounters said wind.

30. The system of claim 29, wherein said body portion is generally a 3-dimensional configuration comprising graphics.

31. The system of claim 29, wherein said edge portion comprises an irregular surface configured to contact a support surface.

* * * * *